US005561278A

United States Patent [19]

Rutten

[11] Patent Number: 5,561,278

[45] Date of Patent: Oct. 1, 1996

[54] MEMBRANE SWITCH

[76] Inventor: Phillip Rutten, 11242 Skyline Dr., Santa Ana, Calif. 92705

[21] Appl. No.: 307,898

[22] Filed: Sep. 16, 1994

[51] Int. Cl.[6] ..... H01H 11/00

[52] U.S. Cl. ..... 200/5 A; 200/512

[58] Field of Search ..... 200/5 A, 512–517, 200/341

[56] References Cited

U.S. PATENT DOCUMENTS

| | | | |
|---|---|---|---|
| 3,590,195 | 6/1971 | Driver | 200/159 B |
| 4,005,293 | 1/1977 | Boulanger | 200/5 A |
| 4,129,758 | 12/1978 | Gilano et al. | 200/5 A |
| 4,293,754 | 10/1981 | Komaki | 200/340 |
| 4,365,408 | 12/1982 | Ditzig | 29/622 |
| 4,463,232 | 7/1984 | Takakuwa | 200/159 B |
| 4,463,234 | 7/1984 | Bennewitz | 200/159 B |
| 4,492,829 | 1/1985 | Rodrique | 200/5 A |
| 4,620,075 | 10/1986 | La Belle et al. | 200/5 A |
| 4,684,767 | 8/1987 | Phalen | 200/5 A |
| 4,771,139 | 9/1988 | DeSmet | 200/5 A |
| 4,916,275 | 4/1990 | Almond | 200/516 |
| 5,136,131 | 8/1992 | Komaki | 200/516 |

*Primary Examiner*—Brian W. Brown
*Assistant Examiner*—Michael A. Friedhofer
*Attorney, Agent, or Firm*—Fulwider Patton Lee & Utecht

[57] ABSTRACT

A membrane switch with multiple switch sites in which, at a given switch site, three concavo-convex structures are juxtaposed over a set of switch contacts so that when the key is pressed, the force applied causes the three structures to cooperate to complete an electrical circuit and close the switch. An operator easily can detect when a switch has been effectively closed because of the superior tactile response resulting from the concavo-convex components. Apertured spacers also are provided to allow the contacts to be brought into communication with each other and to provide a distance through which the actuating force must travel to further enhance tactile feedback to the user.

18 Claims, 3 Drawing Sheets

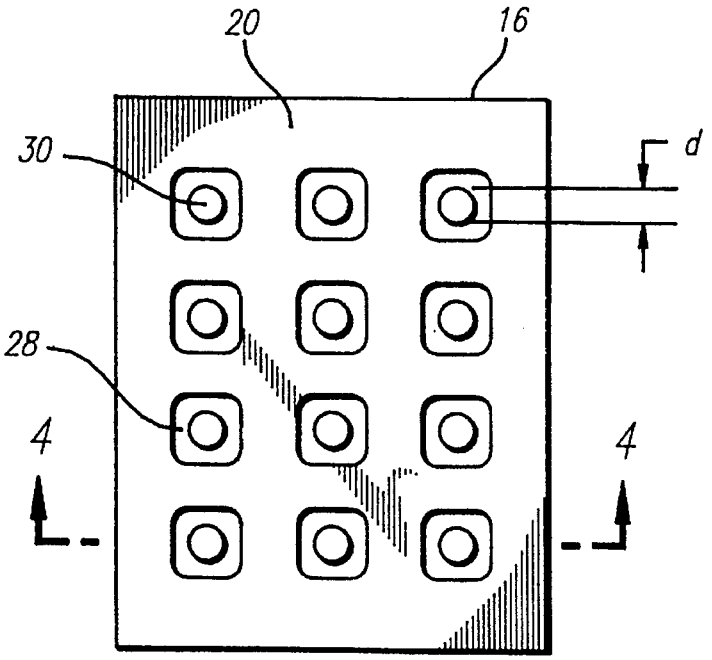
FIG. 3
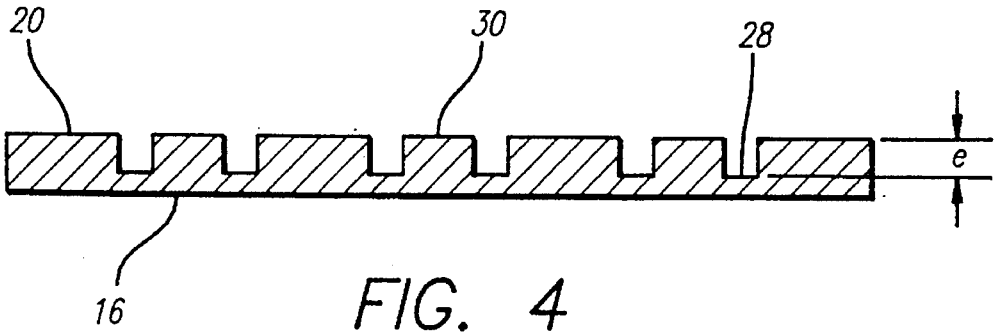
FIG. 4
FIG. 5
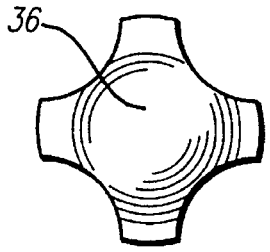

MEMBRANE SWITCH

BACKGROUND OF THE INVENTION

This invention relates generally to improvements in electrical switches and, more particularly, to new and improved compilations of switching elements wherein assemblies of switches are used to provide an enhanced interface between a user and other components of equipment or machinery.

The term "membrane switch" is commonly used to refer to a multilayered device having a series of discrete mechanical switching elements that can be operated independently of each other by applying to the outermost layer at a given switch site a force which is sufficient to make or break the electrical connection of a particular switch element. Most often, membrane switches are designed for intended use as keyboard, key pad, or front panel interfaces to provide instructions from a user to operate various items, such as computers, manufacturing equipment and vending machines. Accordingly, the force required to activate or deactivate any particular switch element is supplied by a finger of a user.

Individual switches can be provided so that the activating force brings the electrical contacts which complete the electrical circuit into communication and thus actuates or closes the switch, providing an electrical signal for use by other circuitry. Alternatively, the switch units can be configured so the electrical circuit normally is completed, and the communication of the contacts is not disrupted until a force is applied to separate the contacts. Combinations of normally open and normally closed switches can be provided in a single membrane switch to best accommodate the requirements of the circuitry supplied by the signals from the switch elements. Membrane switches also are known that include an amalgam of switch types, each of which may comprise two or more switches that are ganged together at a switch site, so that multiple switch signals are sent to the target circuitry when a force is mechanically applied to only one key.

In order for a membrane switch to serve most effectively as an interface device with a human operator, it is desirable that the user be able to sense with a finger when sufficient activating force has been applied to close or open an individual switch. "Tactile feel," "tactile response," or "tactility" are phrases that typically are used to describe this feature of a membrane switch. Generally, such tactility can be incorporated into a switch via two principle design attributes. The first of these is to provide a distance through which the force communicating element must travel before the function of making or breaking the switch contact is accomplished. The second feature is to provide the outermost layer and the force-conveying components at the individual switch sites with structural characteristics sufficient to give the user tactile feedback when a switch has been activated or deactivated.

Unfortunately, the aspects of a switch that would best contribute to tactile response often must be balanced in the design process against other desirable characteristics such as features that enhance the durability of the device. Consequently, optimal tactile feel is difficult to achieve concurrently with optimal cost, manufacturability, reliability and durability. Some layered switch assemblies rely heavily if not exclusively on what has been referred to as "the oilcan effect" to provide an affirmative switch response that can be sensed by the user: i.e., a hemispherical or dome-shaped element is provided to activate or deactivate each switch, which dome snaps in when depressed by a finger to force switch contacts into communication with each other to complete an electrical circuit, and snaps out when the pressure of the finger is removed. This snapping in and out is accompanied by a popping sound or audible clicking and, hence, the response of the switch is detected by the sense of hearing as well as by the sense of touch. The oilcan effect occurs to some extent whenever a dome structure is employed as a force-conveying or circuit-completing element of a layered switch.

However, singular reliance on the oilcan effect to supply a detectable response requires that compromises be made with respect to other design features, such as those which contribute to the longevity or the duty cycle of the device and to the ability to use the device in certain environments. For example, in order to provide a popping response that is significant enough to be sensed by touch and/or hearing by a user, each dome must have a certain minimum height and the domes must be spaced away from the circuit-completing switch contacts by a distance that is great enough to allow the response of the switch-actuating elements to be detected. Traversing this distance requires a strong actuation force which results in substantial deformation of the domes when depressed. The magnitude of the pressure needed to activate such a switch may limit the class of persons who can effectively use or be satisfied with operation of the device and the degree to which each dome is deformed upon being pressed will limit the longevity of the device. In addition, the overall size of a membrane switch can circumscribe the range of equipment and machinery with which the device can be used to interface, especially in applications where minimizing size is a design factor that must be considered. To the extent the sound associated with depression of a switch is significant in providing an assembly with an affirmative response, dependency on the oilcan effect limits the environments where the switch can be effectively used to those in which the popping noise is certain to be detected.

It has also been known to use metal for the exterior layer of a membrane switch because that material tends to improve durability and allows the assembly to be placed in devices that will be operated in relatively harsh environments, for example, outdoor environments. However, this metal layer usually must be cut very thin, so that tactile feel will not be compromised when a finger presses a key, and applies a force to the switch components disposed beneath it. The thinness of the metal also can also further limit the useful life of the assembly.

Other forms of membrane switches include components that are fairly elaborate in structure, such as coverlays with multiple grooves cut out in them, which can increase cost and complexity of manufacture.

Accordingly, those concerned with the development, manufacture, and use of membrane switches have long recognized the need for a membrane switch that optimizes tactile response, but not at the expense of other important aspects of the device such as manufacturability, reliability and versatility. The present invention satisfies this need.

SUMMARY OF THE INVENTION

Briefly, and in general terms, the present invention provides an affirmative tactile response switch assembly with multiple switch sites or keys which incorporates a unique structure featuring a plurality of adjoined switching components disposed in or upon a series of layers, that cooperate to activate a switch when a given key is depressed by the finger of a user providing an enhanced tactile response.

In a presently preferred embodiment, by way of example and not necessarily by way of limitation, a first concavo-convex element is provided as an overlay or membrane of the switch assembly, the convex outer surface of which will be contacted by the operator. Keys or switch sites are defined on the membrane by a suitable graphic technique such as by etching and subsequently filling the etchings with epoxy ink, enamel or another suitable material. Some of the metal in the underside of each switch site is left intact during the etching process, so as to result in a generally circular raised portion in about the center of the undersurface of each key.

This center portion or pellet functions in the manner of a plunger with respect to the second of the concavo-convex components of the switch, which comprises a series of generally dome-shaped elements. The bases of the domes are of such dimensions so as to approximate the dimensions of the keys, and the inner concave surface of each dome is in alignment with a switch site in the membrane.

The third concavo-convex feature is an upper switch layer upon which is embossed a series of hemispheres which are caused to be conductive by application of a conductive ink. Each hemisphere is small enough to fit into the center region of each corresponding dome when pressure is applied to a key. A lower switch layer is provided upon which one or more lower switch contacts are disposed, each of which contact or set of contacts corresponds to a single conductive hemisphere in the upper switch layer.

A membrane switch constructed in accordance with the invention also has additional layers which provide insulation for the electrically conductive elements, and spacer layers to further contribute to tactile response. A connector is provided to bring power into, and switch signals out of, the membrane switch to the associated circuitry.

All of the layers and the dome-shaped elements of the switch are secured by an adhesive or other suitable means to keep the components in proper alignment with each other and to insure that the spacing between layers remains constant, so that the force required to actuate any given switch site will be relatively consistent among the several keys. A back panel made of metal or of another suitable material such as a plastic or particle board can be provided to add strength to the switch.

To actuate a switch, the operator uses a finger to apply a force to a key, which causes the circular pellet on the underside of the switch site to depress the center of the resilient metal dome disposed beneath it. Upon application of pressure, the center of the dome in turn applies force to the concavo-convex upper contact of a switch, which brings it into communication with one or more contacts of a corresponding lower switch that are supplied by an external power source, thus completing the electrical circuit and producing a current proportionate to the now closed position of the switch as a switch signal output. When the pressure is no longer applied, the dome returns to its undeformed configuration, the upper switch contact moves out of connection with the lower switch contact, the electrical circuit is disconnected and the switch ceases to produce an output signal, thus indicating to the associated circuitry that the switch is now open.

A switch according to the invention thus provides a user with enhanced tactile feel, without complicated construction, and can be used effectively over long periods under diverse operating conditions.

Other features and advantages of the present invention will become more apparent from the following more detailed description of the invention, when taken in conjunction with the accompanying exemplary drawings.

BRIEF DESCRIPTION OF THE DRAWINGS

FIG. 3 is a bottom plan view illustrating the underside of the top membrane layer of the switch shown in FIG. 1.

FIG. 4 is an end elevational view of the membrane layer of FIG. 3.

FIG. 5 is a bottom plan view of one of the dome-shaped elements of a switch constructed in accordance with the invention.

DETAILED DESCRIPTION OF THE PREFERRED EMBODIMENT

As is shown in the figures for the purpose of illustration, a preferred embodiment of a membrane switch 10 according to the invention has a plurality of layers 12 which either carry the components which form individual switching units or which contribute to tactility.

While this embodiment is described with respect to particular dimensions or ranges of dimensions certain components might have, the measurements are intended only to improve the clarity of the disclosure and not to limit the invention in any way. As would be obvious to anyone skilled in the pertinent art, the dimensions selected for any particular element or feature of the switch will be those best adapted for the intended end use of the switch.

Figure 1:
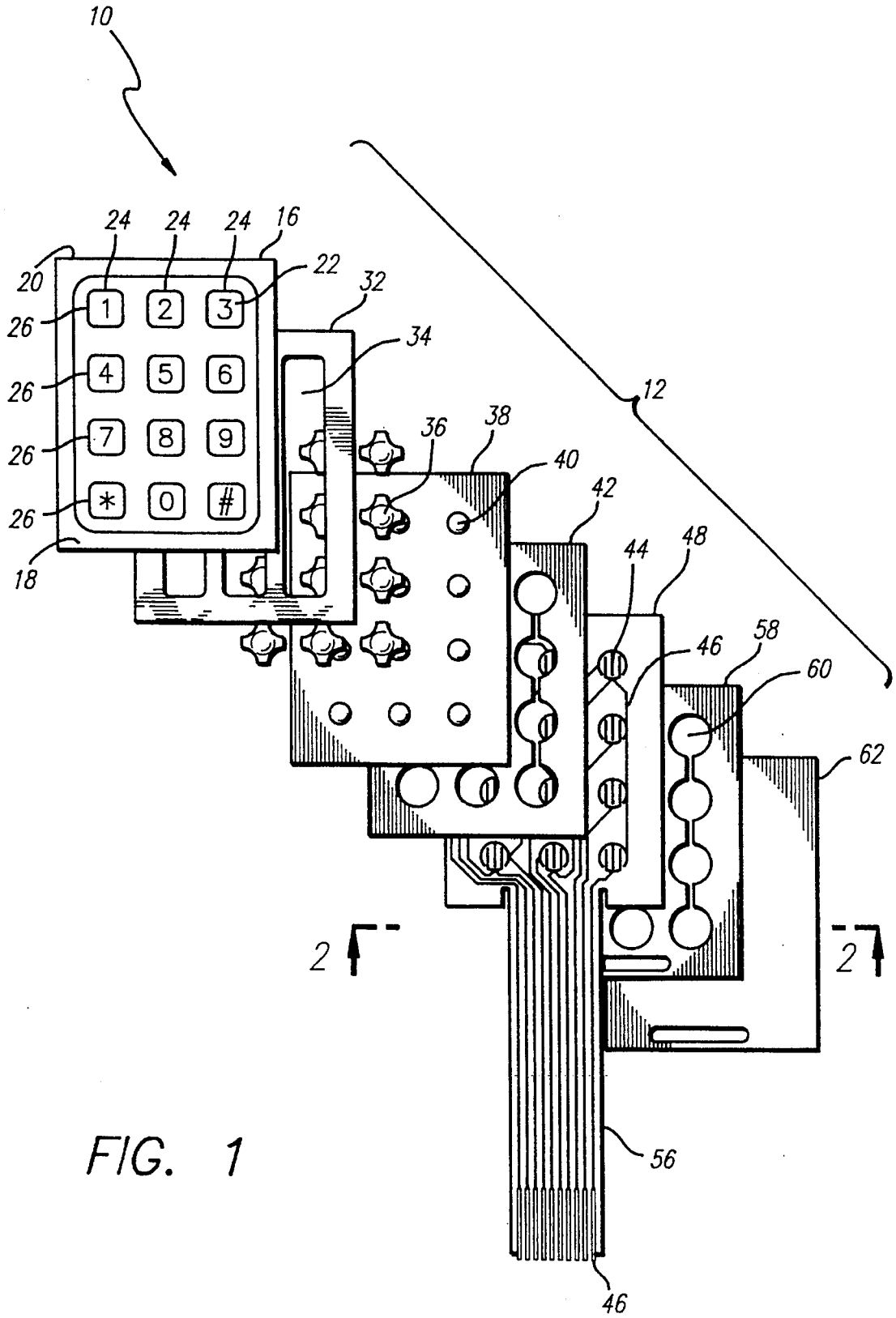
FIG. 1 is an exploded plan view of the components of a membrane switch according to the invention.

As best observed in FIG. 1 of the drawings, the membrane switch 10 overall has the shape of a rectangle, although numerous other shapes for the switch can be conceived of that are at once pleasing to the eye and conducive to easy and efficient operation in terms of a specific application of the device. The switch 10 has a membrane, cover, or overlay 16 with an outer surface 18 and an inner surface 20. The outer surface 18 comprises the exterior of the switch when it is emplaced in whatever machinery or equipment with which it is intended to interface. The membrane 16 is formed from stainless steel, although different materials such as plastics or alloys of other metals might be equally suitable for the overlay given particular uses for the switch. It is contemplated that the thickness of the membrane 16 might vary considerably as dictated by the environmental conditions under which the switch will be operated. For example, where the outer surface 18 of the switch 10 is frequently or constantly exposed to harsh weather conditions, it might be necessary to provide a thicker membrane than would be required in a less severe environment. In the particular embodiment illustrated, the membrane has a thickness, t, on the order of 0.006 inches (0.15 mm). The overlay is slightly concavo-convex, the outer surface 18 being convex and the inner surface 20 being concave. The degree of convexity is not substantial, but the slight curvature contributes to optimal efficient operation and to tactile feedback when the membrane layer 16 cooperates, through a tactile spacer layer, with the other concavo-convex components described below.

A plurality of keys or switch sites 22 are defined on the membrane 16. On the outer surface 18 of the membrane, each key 22 is circumscribed by an appropriate method of applying graphics, such as by etching followed by the application of ink, to set the keys apart from each other and from the body of the overlay. In the preferred embodiment, the keys are arranged in rows 24 and columns 26 and are generally rectangular with rounded corners, a shape which has been found to have both aesthetic appeal and favorable tactile response for typical users. Of course, a wide variety of other shapes and sizes of keys might be favorable for particular classes of users or in certain applications for the switch.

On the inner surface 20 of the membrane 16, an area 28 is etched out of the metal corresponding to the shape of each key that is graphically defined on the outer surface. In the example shown, the depth of the etched area, e, is about 0.0015 inch (0.04 mm). In approximately the center of every etched area, some of the metal has been left intact and not removed during the etching process, to form a pellet or plunger 30. An alternative way of providing this feature is to etch away the entire area under each key border to the desired thickness, and subsequently add and attach the pellets to the inner surface 20 of the membrane 16 with an appropriate technique such as an adhesive. The pellets are generally circular, with a diameter, d, of approximately 0.025 inch (0.64 mm).

A tactile spacer 32 is disposed behind the inner surface 20 of the membrane 16. The spacer 32 has approximately the same peripheral dimensions as the membrane 16 and is provided with apertures 34, each of which corresponds to a column 26 of keys 22. The apertures allow the pellets 30 on the inner surface 20 of the membrane 16 to be brought into communication with the second of the three concavo-convex structures of the switch 10, dome-shaped elements 36, which are provided for each key 22. In a preferred embodiment, the tactile spacer is manufactured from polyester layered on both of its planar surfaces with an acrylic adhesive for affixing the spacer to the membrane and to the layer upon which the domes 36 are mounted. These materials have been found to be well suited for the spacer in terms of effectiveness and cost, although a wide variety of other materials would be equally appropriate depending upon the intended end use of the device. Together with other space-creating layers detailed below, the spacer 32 contributes to tactility by providing a distance through which the actuating force must travel to close a switch at a particular switch site.

The structure of the domes 36 is best observed in FIG. 5. The domes 36 in the preferred embodiment are manufactured from metal, in particular from stainless steel, and each is dimensioned so as not to exceed the dimensions of the etched area 28 on the inner surface 20 of the membrane 16 at each key 22. Stainless steel is believed to afford optimal resiliency and durability for this component of the switch 10, because the domes will not permanently deform or otherwise deteriorate after repeated depressions whenever a switch site is activated.

The domes 36 are attached with strips of adhesive-backed polyester to another polyester layer 38 upon which a plurality of upper switch contacts 40 are disposed. These upper switch contacts 40 comprise a third concavo-convex structure at each key 22, and are formed by depositing on the polyester substrate 38 rows and columns of conductive silver ink. Each upper switch contact 40 is dimensioned to principally fill the center area of each dome 36 mounted above it, such that the convex surface of the switch contact is disposed against the concave surface of the dome.

An apertured insulative layer 42 lies below the upper switch contacts 40, to separate those contacts from the lower switch contacts 44 when a given switching unit 14 is not being activated. The openings 41 in the insulative layer 42 are generally circular with just great enough of a diameter to accommodate the perimeter of the domes 36 and the lower switch contacts 44 when the two are pressed into communication as a key 22 is pressed. The apertures further provide internal venting for the switch 10 when power is applied.

A lower switch layer 48 also is manufactured by depositing conductive silver ink onto a polyester substrate. Traces 46 form a ring contact 52 and a center contact 54 for each switching unit 14. Other configurations of upper and lower switch contacts are contemplated that would be equally effective in completing a circuit to close the switch, such as a leaf spring arrangement. Unlike the other layers of switch 10 which are generally rectangular and of the same overall dimensions, the lower switch layer 48 has an extension or tail connector 56 upon which traces 46 are routed for ultimate connection to a power source (not shown) and the external circuitry with which the switch will interface.

Figure 2:
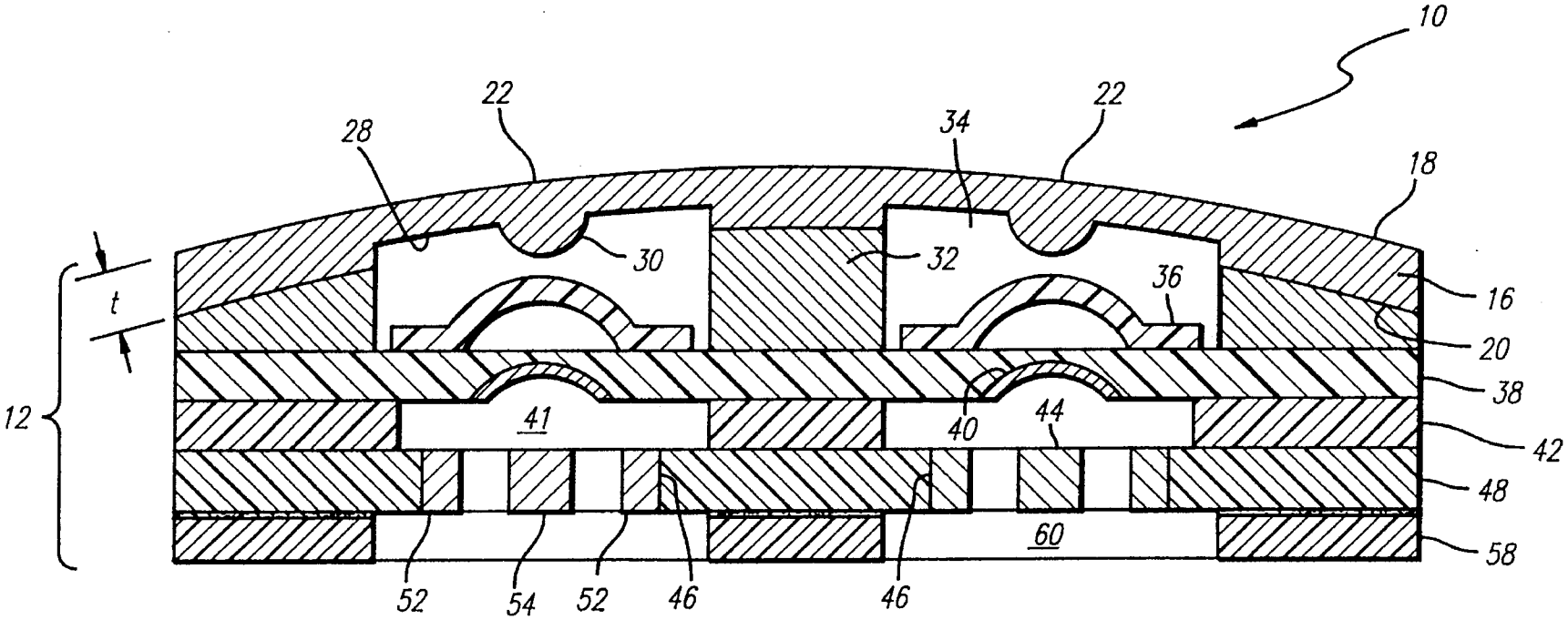
FIG. 2 is an enlarged elevational view of a switch according to the invention.

As best observed in FIG. 2, another polyester spacer layer 58 is adjoined by a coating of acrylic adhesive to the lower switch layer 48, and also is fitted with circular apertures 60. These apertures further contribute to tactile response when a switch site is actuated and also provide venting for the switch 10.

Another feature of the invention that is optionally provided is shown in FIG. 1 and includes a back panel 62 of metal or plastic or other suitable material which is adhered to the spacer layer 58 to add strength to the switch protect all but the connector 56 from the internal environment of the device that is the subject of interface. Hermetically sealing the components of the switch usually is desirable, in order to protect its inner workings from moisture, heat, ultraviolet light, or dust and other debris. However, it is contemplated that the switch might be put to use in other environments in which an alternative to a hermetic seal might be preferred.

After the switch 10 is assembled into the equipment or machinery with which it is to be operated and connected to external circuitry, a given switching unit can be activated by pressing the appropriate key 22 on the membrane 16. The force supplied by the finger of an operator brings pellet 30 into contact with a dome 36 through the polyester in the strip holding the domes to the upper switch layer 38. The center of the dome is depressed and causes an upper switch contact 40 to be forced into communication through the aperture in the insulative layer 42 with a pair of lower switch contacts 52, 54 which are supplied by an external power source connected to certain of the traces 42 on connector 56. The electrical circuit for the particular switch unit thus is completed and a signal indicating the switch has been closed is available at a trace on the connector 56 for use by the circuitry. When the user removes the actuating force, the resilient character of three juxtaposed concavo-convex structures causes the membrane 16, dome 36 and upper switch contact 40 to return to the resting, non-deformed condition, which has the effect of breaking the connection between the upper switch contact and the ring contact 52 and the center contact 54 in the lower switch.

From the foregoing, it will be appreciated that the membrane switch of the invention provides an enhanced tactile response with an uncomplicated and durable structure, which can be relied upon to operate in a variety of applications over an extended period of time.

While a particular form of the invention has been illustrated and described herein, it will be apparent to those of ordinary skill in the art that other modifications can be made without departing from the spirit and scope of the invention.

For example, many variations of configurations of switch contacts can be implemented with the concavo-convex membrane and several different materials can be used for the components of the switch, depending on the environment in which it is used. Accordingly, it is not intended that the invention be limited except as by the appended claims.

What is claimed is:

1. A tactile response switch assembly, comprising:

a plurality of superposed layers including a membrane layer having a concave outer surface and a convex inner surface, upon which a plurality of switch sites are defined;

a switch actuator layer; a first switch contact layer;

a second switch contact layer adapted to be connected to associated circuitry;

at least one insulative layer disposed between said first switch contact layer and said second switch contact layer to prevent electrical shorting of any of said switch sites; and a spacer layer disposed between said switch actuator layer and said first switch contact layer to provide a distance through which activation or deactivation of any of said switch sites can be sensed when an actuating force is applied thereto.

2. The switch assembly of claim 1, wherein said switch actuator is a structure approximating the shape of a dome having a concave surface and a convex surface, said switch actuator being aligned with said membrane layer so that said concave surface of said membrane layer contacts said convex surface of said dome when force is applied to any of said switch sites.

3. The switch assembly of claim 2, wherein said first switch contact layer comprises a boss corresponding to each of said switch sites, the boss being formed from an electrically conductive material, and having a concave surface and a convex surface, with said convex surface of said boss in alignment with said concave surface of said dome.

4. The switch assembly of claim 3, wherein said second switch contact layer comprises a substrate on which is disposed a pair of electrically conductive traces corresponding to each of said switch sites.

5. The switch assembly of claim 4, wherein said insulative layer disposed between said first switch contact layer and said second switch contact layer has openings to allow the each of said bosses and each of said pair of electrically conductive traces to be brought into communication when a force is applied to any of said switch sites.

6. The switch assembly of claim 5, wherein one of said spacer layers is superposed between said membrane layer and said switch actuator layer.

7. A multilayered membrane switch for an electrical circuit, the switch comprising:

a plurality of switching units, each said switching unit including a first switch contact and a second switch contact, said second switch contact aligned in a layer below said first switch contact, and a plurality of concavo-convex elements aligned in layers above said contacts, one of which said elements is an overlay covering said plurality of switching units having an outer surface that is convex and an inner surface that is concave, said concavo-convex elements cooperating to complete the electrical circuit between said first switch contact and said second switch contact when a mechanical force is applied to any said switching unit.

8. The membrane switch of claim 7, wherein said concavo-convex elements further include a dome having an upper surface that is convex and a lower surface that is concave, said overlay being aligned with said dome so that when mechanical force is applied, said convex surface of said overlay is brought into contact with said concave surface of said dome.

9. The membrane switch of claim 8, wherein said first switch contact is aligned in a layer below said dome so as to register with said dome when a force is applied, and said first switch contact has an upper surface that is convex and a lower surface that is concave.

10. An electro-mechanical interface for conveying electrical signals to associated circuitry, the interface comprising:

a plurality of switching components disposed in interconnected multiple layers, said switching components being capable of interaction when supplied by a pressure force, wherein said multiple layers including a resilient switch-actuating layer, a first contact-bearing switch layer, a second contact-bearing switch layer, and a covering layer upon which at least one switch site is circumscribed;

said resilient layer having at least one force-conveying element;

said first contact-bearing switch layer being spaced apart from and insulated from said second contact-bearing switch layer;

said second contact-bearing switch layer being in communication with the associated circuitry and having at least one switch contact; and said covering layer having an interior surface and an exterior surface, said interior surface being concave and said exterior surface being convex.

11. A membrane switch for completing an electrical circuit with an improved tactile response, comprising:

a pair of electrically conductive switch contacts; and a plurality of concavo-convex elements each having an upper surface that is concave and lower surface that is convex, said plurality of elements being in alignment with every other of said plurality of elements and with said pair of switch contacts, the uppermost of said elements comprising a membrane layer having a degree of convexity and a degree of concavity less than that of every other of said plurality of concavo-convex elements, said concavo-convex elements cooperating to complete the electrical circuit between said pair of contacts when a mechanical force is applied to said concavo-convex elements.

12. The switch assembly of claim 11 wherein said concavo-convex elements further include a dome.

13. The switch of claim 12, wherein one of said pair of electrically conductive switch contacts also is concavo-convex, having an upper surface that is convex and a lower surface that is concave.

14. The switch assembly of claim 13, wherein said membrane, said dome and said pair of electrically conductive switch contacts are spaced apart from each other by a spacer layer disposed between said dome and said pair of electrically conductive switch contacts and an insulative layer disposed between the first of said pair of electrically conductive switch contacts and the second of said pair of electrically conductive switch contacts.

15. A tactile-response switch assembly, having a plurality of superposed layers comprising:

a membrane layer having an inner surface which is concave and an outer surface which is convex, and at least one switch site being formed in said membrane layer;

a switch actuator layer disposed below said membrane layer, having a switch actuator corresponding to each of said switch sites, each said switch actuator having an inner surface which is more concave than, and an outer surface which is more convex than, said membrane layer, and which is designed to contact the portion of said membrane layer at each said switch site;

a spacer layer disposed between said membrane layer and said switch actuator layer, said spacer layer having at least one aperture through which each said portion of said membrane layer at each said switch site can be brought into contact with said outer surface of each said switch actuator;

an upper switch layer disposed below said switch actuator layer, having an upper switch corresponding to each said switch actuator and each said key site, each said upper switch being formed of an electrically-conductive material and having an inner surface which is more concave than, and an outer surface which is more convex than, said inner and outer surfaces of said membrane layer;

a lower switch layer disposed below said upper switch layer and having at least one lower switch electrical contact corresponding to each said upper switch, such that when each said upper switch is pressed into contact with each said lower switch contact an electrical circuit is completed;

an insulative layer disposed between said upper switch layer and said lower switch layer to prevent an electrical circuit from being completed in the absence of a force applied to each said upper switch; and a power connector in communication with each said electrical contact on said lower switch layer.

16. The tactile-response switch assembly of claim 15, wherein a plunger is formed on the inner surface at each said switch site.

17. The tactile-response switch assembly of claim 15 wherein a second spacer layer is disposed below said lower switch layer.

18. A membrane switch assembly comprising a plurality of layers and having at least one switch for which an electrical circuit is completed by transferring a force through a series of three concavo-convex elements, the first of said elements comprising an membrane layer of the switch assembly, the second of said elements disposed in a switch-actuating layer of the switch assembly, and the third of said elements disposed in an upper switch contact layer of the switch assembly, each of said elements having an outer surface and inner surface:

said outer surface of said membrane layer is convex and said inner surface of said membrane layer is concave;

a key site is defined in said membrane layer for each switch;

said outer surface of said switch-actuating layer element is more convex than said outer surface of said membrane layer;

said outer surface of said upper switch contact layer element is more convex than said outer surface of said membrane layer, and said upper switch contact layer element is in alignment with said switch-actuating layer element and with a contact disposed in a lower switch layer, said lower switch layer adapted to be connected to a source of electrical power; and an insulative layer disposed between said upper switch contact layer and said lower switch contact layer to prevent a short circuit when a switch actuating force is not being applied to said concavo-convex elements.

* * * * *

UNITED STATES PATENT AND TRADEMARK OFFICE

CERTIFICATE OF CORRECTION

PATENT NO. : 5,561,278

DATED : Oct. 1, 1996

INVENTOR(S) : Philip Rutten

It is certified that error appears in the above-indentified patent and that said Letters Patent is hereby corrected as shown below:

On the title page, item [76], change "Phillip" to --Philip--.

Column 5, Line 67, After "switching unit", delete "14".

Column 6, Line 10, After "switching unit", delete "14".

Signed and Sealed this

Eighteenth Day of February, 1997

Bruce Lehman

*Attest:*

BRUCE LEHMAN

*Attesting Officer*

*Commissioner of Patents and Trademarks*